US006186439B1

(12) United States Patent
Carey

(10) Patent No.: US 6,186,439 B1
(45) Date of Patent: Feb. 13, 2001

(54) ROLLED PRODUCT DISPENSER ASSEMBLY

(76) Inventor: Philip R. Carey, 9747A US 224 W., Van Wert, OH (US) 45891

( * ) Notice: Under 35 U.S.C. 154(b), the term of this patent shall be extended for 0 days.

(21) Appl. No.: 09/400,936

(22) Filed: Sep. 22, 1999

(51) Int. Cl.[7] ..... B65H 18/04

(52) U.S. Cl. ..... 242/596.3; 242/596.4; 242/596.7; 242/599.3; 242/599.4; 242/597.8

(58) Field of Search ..... 242/596, 596.3, 242/596.4, 596.5, 596.8, 598.2, 598.1, 596.6, 596.7, 599.2, 599.3, 599.4, 590, 597.8, 598.5

(56) References Cited

U.S. PATENT DOCUMENTS

| | | | | |
|---|---|---|---|---|
| D. 307,844 | | 5/1990 | Romeka | D6/523 |
| D. 327,193 | | 6/1992 | Crook et al. | D6/523 |
| D. 362,773 | | 10/1995 | Kartchner | D6/523 |
| 1,341,484 | * | 5/1920 | Starratt | 242/596.5 X |
| 1,398,308 | * | 11/1921 | Weeks | 242/596.3 |
| 1,577,451 | * | 3/1926 | Delerue | 242/596.4 |
| 1,625,190 | * | 4/1927 | Boynton | 242/596.4 |
| 1,778,282 | * | 10/1930 | Stewart | 242/596.3 |
| 2,072,519 | * | 3/1937 | Carpenter et al. | 242/596.3 |
| 2,146,038 | * | 2/1939 | West | 242/596.3 X |
| 2,555,885 | * | 6/1951 | Hope | 242/596.7 |
| 2,879,012 | * | 3/1959 | Sarro | 242/596.3 |
| 4,452,403 | | 6/1984 | Arronte . | |
| 4,614,312 | | 9/1986 | Del Pino . | |
| 5,149,003 | | 9/1992 | Tharp . | |

* cited by examiner

*Primary Examiner*—Donald P. Walsh
*Assistant Examiner*—William A. Rivera
(74) *Attorney, Agent, or Firm*—Baker & Daniels

(57) ABSTRACT

A dispenser assembly for dispensing product arranged in a roll and the roll has a cavity disposed at each end of the roll. The dispenser assembly includes a base, a pair of arms having first and second ends and at least one roller associating with the second end of the respective arm. The first end of each arm attaches to the base and each second end extends outwardly from the base. The roller has a roll engaging portion which is structured and arranged to extend from the second end into the respective cavity of the roll when the roll is inserted into the arms.

20 Claims, 6 Drawing Sheets

ROLLED PRODUCT DISPENSER ASSEMBLY

BACKGROUND OF THE INVENTION

1. Field of the Invention

The present invention relates to rolled product dispensers for use with rolled product such as paper towels, toilet tissue, plastic sheet or the like, including the residential and commercial applications of: toilet tissue dispensing, paper towel dispensing and food preservation bag and wrap dispensing.

2. Background Art

A variety of devices are used to dispense material arranged in a roll. Product arranged in a roll typically includes rolled perforated sheet stock such as toilet tissue, paper towels, plastic produce bags and the like. The rolled product is typically wound into a cylinder and a hollow portion or core extends through the roll. Dispensers heretofore disclosed typically are of the two armed type which may be further classified into two types. A first type includes a biased spindle or collapsible member which spans the arms to support the roll thereon. The spindle extends through the core of the roll and supports the same by contacting and aligning with an interior wall which defines the core. The second type of dispenser lacks the biased spindle and, in contrast to the spindled type, each arm includes a cantilevered plunger generally extending inwardly and towards the roll. Plunger type dispensers support the roll by the interior of the core, proximate to each opposing end of the roll, being in contact with portions of the plungers penetrating the core. Typically, the plunger type of dispenser either includes a biased arm assembly or a biased plunger assembly to ease the task of installing and removing the roll.

A disadvantage encountered with conventional spindle type dispensers includes requiring two hands to collapse the biased spindle when installing and removing the roll. Moreover, each end of the spindle requires aligning with the respective arm to mount the spindle to the two arms. Handling the spindle to install or remove the roll results in cumbersome and inconvenient replacement of rolls. Also, the spindle may be mishandled resulting in the dispenser coming apart and thereafter being rendered unusable. A common problem with spindle type dispensers used in commercial settings is that loose dispenser parts, such as the spindle, are stolen. Another disadvantage often experienced with the spindle dispensers is that under sizing of the spindle generally causes a loose fit between the roll and the spindle leading to over-spin of the roll and an associated excess dispersing of product. Yet another disadvantage incident with spindle type dispensers is that children, elderly persons and handicapped persons do not possess the dexterity required to install the roll onto, or remove the roll therefrom, the spindle type dispenser. Furthermore, it is often difficult to seat the rolled product core over the plungers, and once seated, the rolled product is often easily displaced from the plungers.

Disadvantages associated with plunger type dispensers include roll installation often requires the user to place each roll end, consecutively, over each plunger while spreading the arms apart wide enough to initially receive the roll. Generally, a person wishing to install a roll onto the plunger dispenser must use a first hand to spread apart the arms and then use their remaining hand to mount the roll on the plungers. Moreover, many plunger type dispensers include plungers that substantially engage the core of the roll which provides excess friction on the roll resulting in defective dispensing of the rolled product.

SUMMARY OF THE INVENTION

The dispenser of the invention provides a roller to facilitate the installation and removal of rolled product. The roll retaining structure allows the roll to revolve as product is dispensed, while the roller component operates as the rolled product is inserted or withdrawn.

The dispenser assembly embodiments, further described below, are generally U-shaped and have a pair of outwardly extending arms with rollers associated at each end thereof. Installing a roll requires a user to transport a roll, single handedly if desired, into contact with the rollers. The rollers react by moving to ease the roll onto the dispenser assembly. Removal of a spent roll requires the user to merely grasp the spent roll, also single handedly if desired, and transport it away from its mount. The rollers move to accommodate the departing roll and thereafter the dispenser stands prepared to accept a new roll. Movement of the rollers is incident with roll insertion and removal, also termed engagement and disengagement, respectively, however the rollers remain relatively stationary when the rolled product is being dispensed from the rolled product dispenser. This selective roller movement allows for expedient and relatively effortless roll engagement and disengagement while exacting and imparting a controlling tension or "drag" to the roll in preventing wobbly and otherwise excess dispensing of product.

The present invention provides a rolled product dispenser assembly for dispensing product arranged in a roll, the roll includes a cavity disposed at each end, including a base and a pair of arms. The arms have first ends attaching to the base and second ends extending outwardly from the base. At least one roller is associated with one of the second ends of the arms by having a roll engaging portion structured and arranged to extend from the second end into the cavity of the roll when the roll is inserted into the arms.

The present invention also provides a dispenser assembly including at least one connecting member including a first end and a second end. The first end of the connecting member is rotatably attached to the respective arm and the second end of the connecting member attaches to the respective roller, the connecting member rotatably attaches to the respective arm, whereby the connecting member is capable of rotating when the roll is urged against the roller.

The present invention also provides a dispenser assembly including at least one of the second ends of the arms forming an enclosure and the respective roller is disposed within the enclosure. A retainer retains the roller in the enclosure so that the roller contacts the retainer when the roll is generally engaged with the roll engaging portion of the roller.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
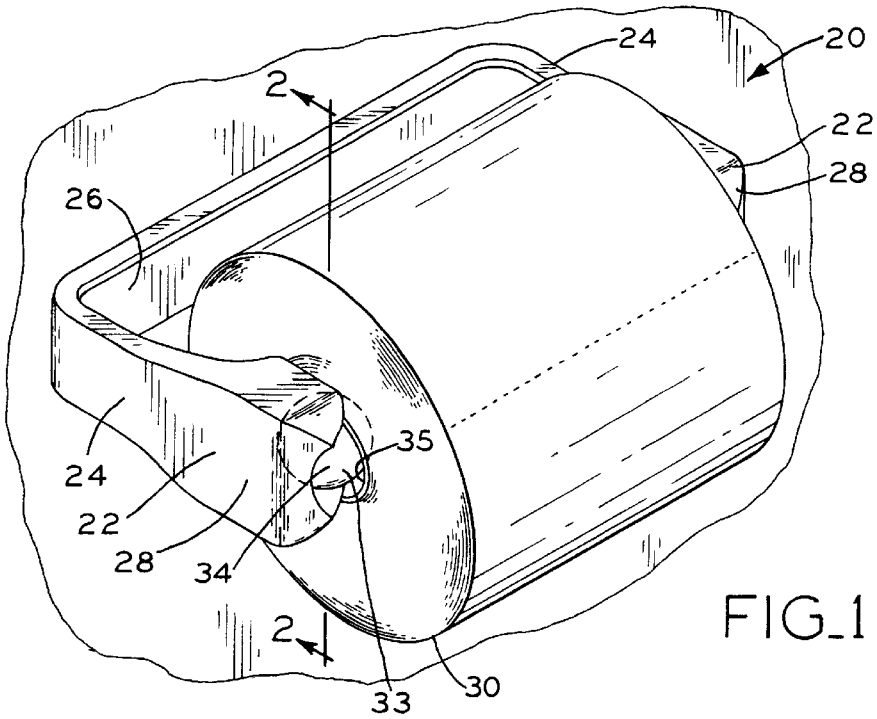
FIG. 1 is a perspective view of a first embodiment of a rolled product dispenser assembly according to the present invention, showing an engaged roll.

Corresponding reference characters indicate corresponding parts throughout the several views. Although the drawings represent an embodiment of the present invention, the drawings are not necessarily to scale and certain features may be exaggerated in order to better illustrate and explain the present invention. The exemplification set out herein illustrates an embodiment of the invention, in one form, and such exemplifications are not to be construed as limiting the scope of the invention in any manner.

DETAILED DESCRIPTION OF THE INVENTION

The embodiments disclosed below are not intended to be exhaustive or limit the invention to the precise forms disclosed in the following detailed description. Rather, the embodiments are chosen and described so that others skilled in the art may utilize its/their teachings.

Rolled product dispenser assembly 20 is shown in FIG. 1 having a pair of arms 22. First ends 24 of arms 22 attach to base 26 and second ends 28 extending outwardly from base 26. Roll 30 is received between the arms 22 by a pair of rollers 33 positioned at second ends 28 of arms 22. The term "roll" is understood to refer to any product, including but not limited to tissue, paper, or plastic, that is configured in a roll and having either hollow core 35 extending through roll 30 or at least a cavity on each end 31 of roll 30. Rollers 33 of dispenser assembly 20 are a pair of spheres 34. Each arm 22 associates with a respective sphere 34 at second end 28 of each arm 22. However, having only one of the pair of arms associating with a respective sphere is sufficient to achieve advantages of the invention, while the remaining arm may include a sphere or other projection rigidly attached, to effectively dispense rolled product.

Figure 2:
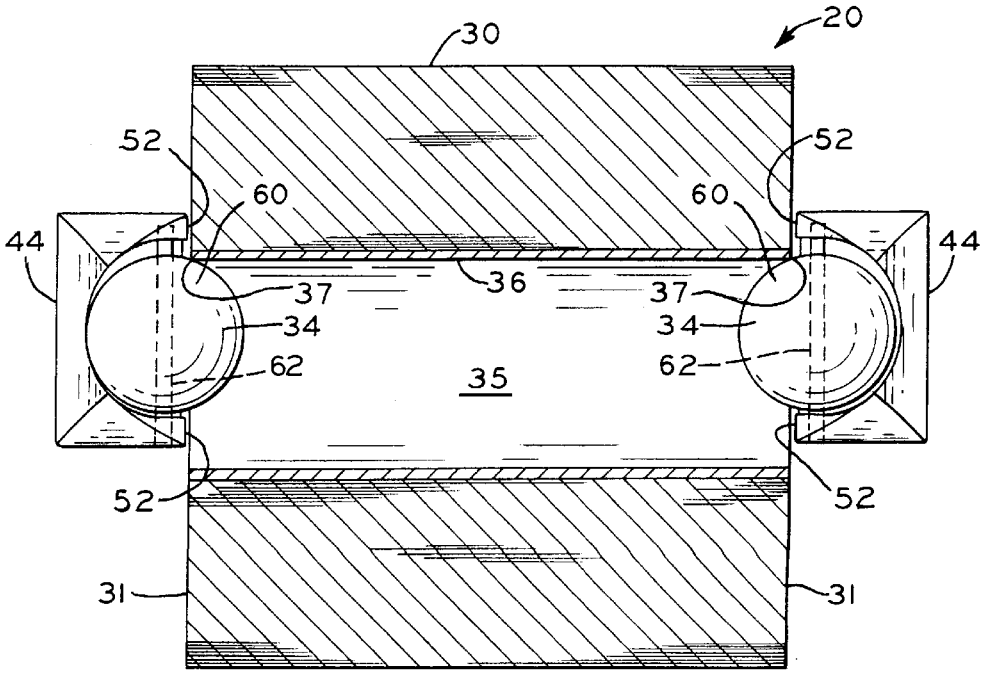
FIG. 2 is a front sectional view of FIG. 1 taken along view lines 2—2.
Figure 3:
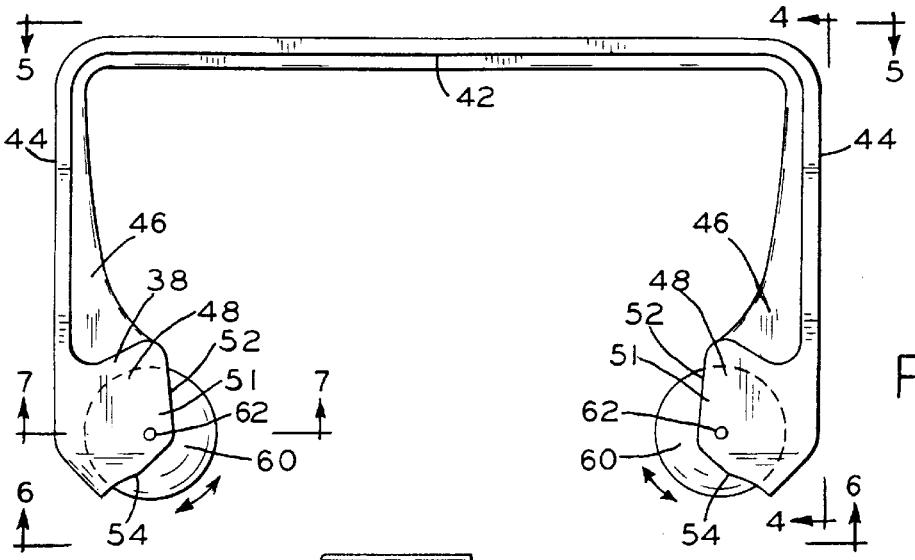
FIG. 3 is a bottom view of the rolled product dispenser shown in FIG. 1.
Figure 4:
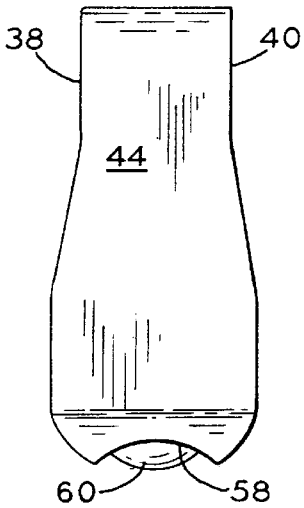
FIG. 4 is a side view of the rolled product dispenser assembly shown in FIG. 3 taken along view lines 4—4.
Figure 5:
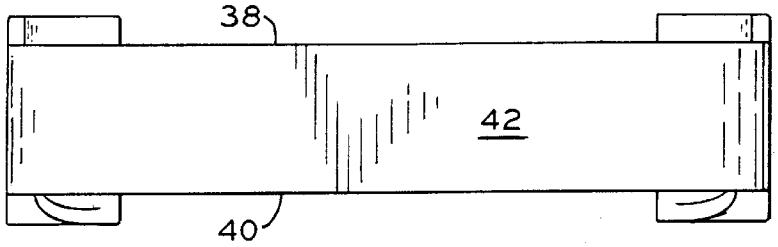
FIG. 5 is a rear view of FIG. 3 taken along view lines 5—5.
Figure 6:
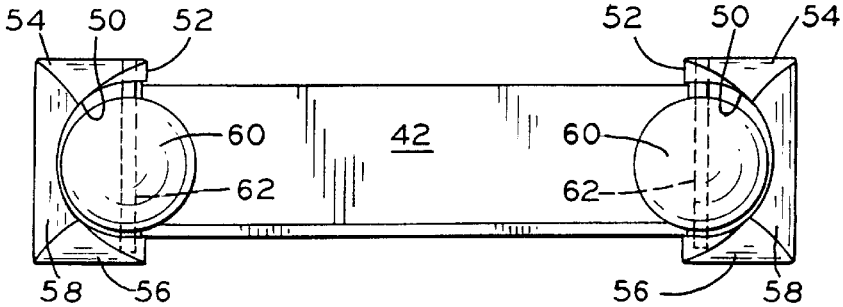
FIG. 6 is a front view of FIG. 3 taken along view lines 6—6.

FIG. 2 shows rolled product dispenser 20 supporting roll 30 between arms 22 so that roll 30 is in an "engaged position" on dispenser assembly 20. Each arm 22 includes sphere 34 contact wall portions 36 of core 35 at contact point 37. Each roll end 31 contacts a mid-portion of each sphere 34 and an inward force on the roll end 31 is provided by sphere 34 being inwardly biased by arm 22. The rolled product is supported and, in addition, provides enough tension on roll 30 to allow efficient dispensing of rolled product.

Another roll support structure includes each arm 22 having seat 52 contacting and inwardly applying force on each end 31 of roll 30. Roll 30 is suspended by seat 52 forcibly contacting ends 31 of roll 30, however, wall portions 36 of core 35, contacting spheres 34 at contact points 37 located on each sphere 34 provide additional support. Minimizing the contact area between roll 30 and core 35 alleviates interference of spheres 34 on roll 30 during dispensing the rolled product from dispenser assembly 20. Furthermore, the inward force provided to roll 30 by arms 22 as described above, specifically the force each seat 52 has against roll ends 31, provides a generally constant drag on roll 30 to prevent otherwise uninterrupted "free-rolling" of roll 30.

Dispenser assembly 20 is shown in further detail in FIGS. 3–8 as including bottom surface 38, top surface 40, which is generally parallel to the bottom surface 38, back surface 42, and a pair of outer surfaces 44. Each arm 22 includes inner surface 46 which is located opposing each outer surface 44. Second end 28 of arm 22 includes cradle portion 48, having socket 50 which accommodates each sphere 34. Each of spheres 34 fit and rotate within each socket 50. Each cradle portion 48 includes seat 52 located at innermost portion 51 of each of pair of arms 22. As mentioned above, only one sphere 34 need associate with one of the pair of arms 22 to effectively dispense rolled product. Each seat 52, as described above, is in contact with and applies an inward force to ends 31 of roll 30. Each cradle portion 48 also includes front relief 54, rear relief 56 and side relief 58 so that engaging portions 60 of spheres 34 are generally exposed to facilitate receiving roll 30.

Figure 7:
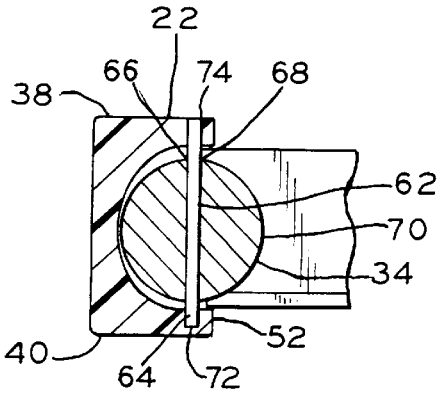
FIG. 7 is a partial sectional front view of FIG. 3 taken along view lines 7—7.

FIG. 7 details the attachment of one of spheres 34 to respective arm 22, with pin 62 having first end 64 and second end 66 fitting through aperture 68 of the respective sphere 34 so that sphere 34 freely rotates about pin 62. First end 64 of pin 62 interferringly fits, and is restrained within, aperture 72. Aperture 72 is disposed in cradle portion 48 of respective arm 22, proximate to top surface 40 of rolled product dispenser 20. Second end 66 of pin 62 interferringly fits and is restrained within aperture 74. Aperture 74 is located in cradle portion 48 proximate to bottom surface 38 of rolled product dispenser 20. Sphere 34 rotates freely about pin 62 and generally within a horizontal plane.

Figure 8:
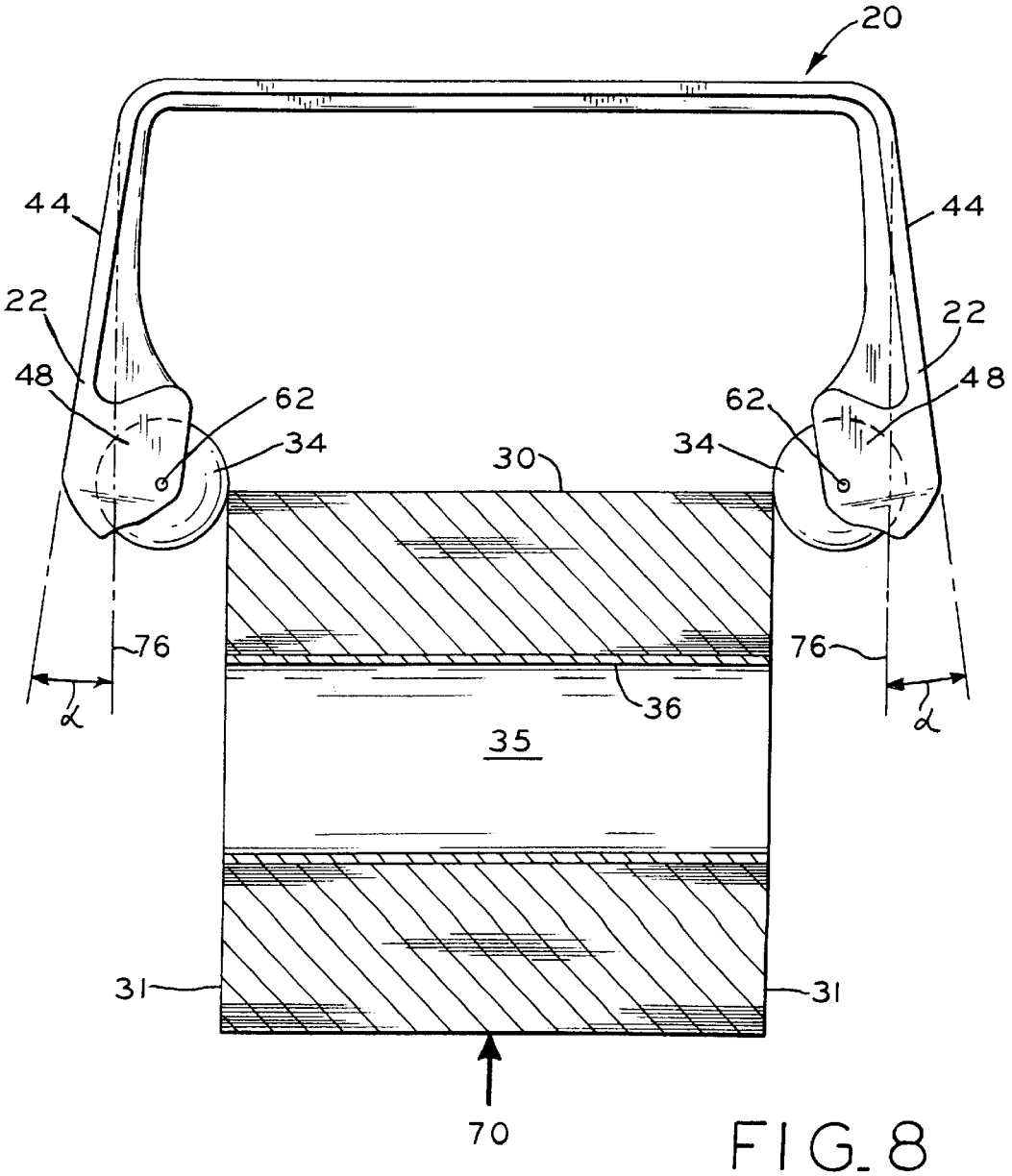
FIG. 8 is a bottom view in partial cross-section of the dispenser and rolled product of FIGS. 1–7 showing the roll deflecting the pair of arms.

Roll 30 is shown being urged between the pair of arms 22 in direction 70 of FIG. 8. Initially, roll 30 contacts spheres 34 and thereafter further movement of roll 30 towards dispenser assembly 20 creates a contemporaneous response comprising of rotation of spheres 34 and outward deflection of arms 22. More specifically, spheres 34 rotate inwardly and within a generally horizontal plane while each cradle portion 48 deflects generally outwardly and away from ends 31 of the engaging roll 30.

Figure 13:
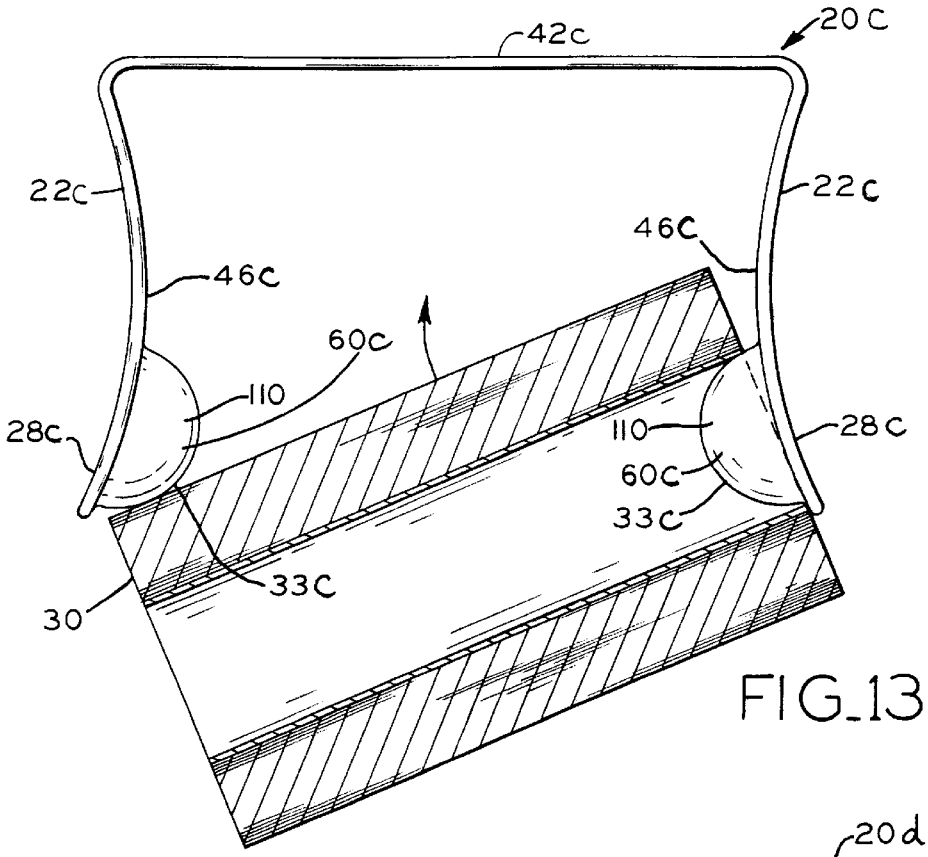
FIG. 13 is a top view of a fourth embodiment of a rolled product dispenser assembly according to the present invention.

Angle $\alpha$ shown in FIG. 8 represents a maximum deflection of which each arm 22 experiences with respect to generally vertical reference plane 76. Angle $\alpha$, respective to each arm 22, will be similar to the opposing angle $\alpha$ of remaining arm 22, since the physical dimensions and characteristics of each arm 22 of dispenser assembly 20 are similar. When roll 30 is urged against both spheres 34, arms 22 resiliently deflect simultaneously with the rotation of spheres 34 until spheres 34 extend into core 35 of roll 30. Complete engagement of roll 30 with dispenser assembly 20 corresponds to when each deflecting arm 22 "snaps back" into its original position, with side surfaces 44 of each respective arm 22 aligning with generally vertical reference planes 76. Generally, roll 30 is preferably installed by placing one of ends 31 of roll 30 over one sphere 34 and then urging the remaining roll end 31 against the remaining sphere 34 until the remaining sphere 34 extends into core 35 of roll 30 (FIG. 13). This latter roll engagement method causes only the remaining sphere 34 to significantly rotate, however, both arms 22 elastically deflect corresponding to angle $\alpha$.

Dispenser assembly 20 is constructed of a flexible plastic or other like material having sufficient resiliency and which lends to a reproducible part manufacturing process such as injection molding or other similar process. In the exemplary embodiment, plastic is used as the flexible material. Other potentially suitable materials include flexible metals and ceramics for use with the limited flexing arm embodiments.

Figure 9:
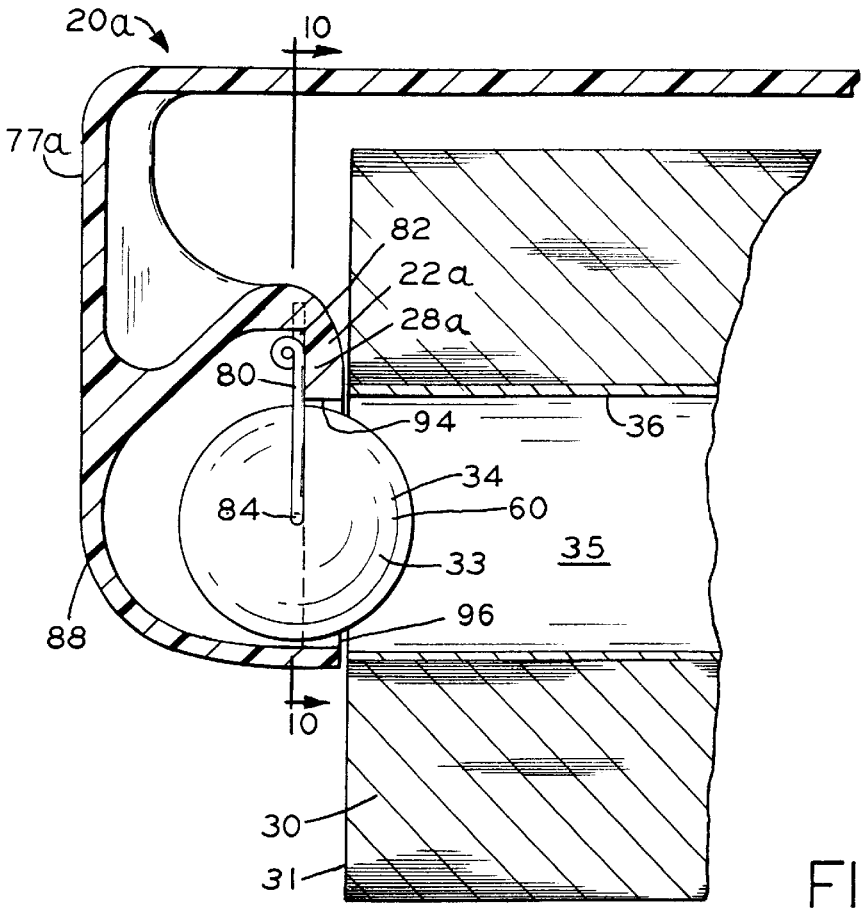
FIG. 9 is a partial sectional top view of a second embodiment of a rolled product dispenser assembly according to the present invention, showing an engaged roll.
Figure 10:
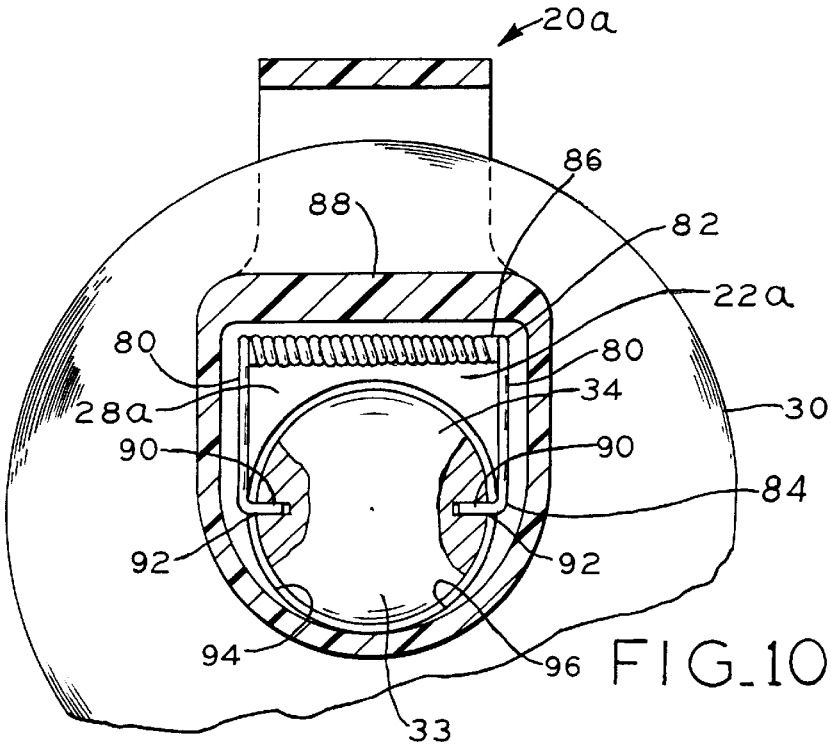
FIG. 10 is a partial sectional side view of FIG. 9 taken along view lines 10—10.

A second embodiment of the dispenser assembly 20*a* of the present invention is shown in FIG. 9 and FIG. 10 and includes a pair of connecting members 80, attached to respective arms 22*a*. Connecting members 80 rotate in response to roll 30 being urged between arms 22*a*, however, unlike the first embodiment dispenser assembly 20, arms 22*a* do not generally deflect. More specifically, first end 82 of each connecting member 80 is rotatably attached by way of spring hinge 86 to arm 22*a*. Spring hinge 86 is a one piece unit commonly manufactured from piano wire and has the function of both a hinge and a torsion spring. Second end 84 of each connecting member 80 includes a pair of pin members 90 which associate with the respective pair of rollers 33. Each roller 33 comprises sphere 34 and each sphere 34 includes a pair of apertures 92 receiving pin members 90 so that each sphere 34 rotates freely about its pin members 90. Second end 28*a* of each arm 22*a* includes aperture 94 to allow engaging portion 60 of sphere 34 to extend into aperture 94. Aperture 94 defines rim 96 such that rim diameter 96 is slightly larger than the diameter of sphere 34. When roll 30 is engaged with dispenser assembly 20*a*, each sphere 34 extends into core 35 of roll 30 and the depth of sphere 34 is limited by pin members 90 resting against rim 96. During installation or removal of roll 30, roll 30 is brought into contact with spheres 34 and further inward positioning of roll 30 causes spheres 34 to move away from roll 30 such that pin members 90 lift off of rim 96 while each connecting member 80 rotates or pivots about spring hinge 86. Finally, cover 88 is provided to enclose each sphere 34 and respective connecting member 80. Dispenser assembly 20*a* also effectively dispenses rolled product if only one roller 33 rotates and its respective connecting member 80 pivots while the other roller 33 and respective remaining connecting member 80 remains generally stationary and fixed with respect to the respective remaining arm 22*a*. Rolled product may also be loaded by manually displacing either arm 22*a* and thereafter installing roll 30.

Figure 11:
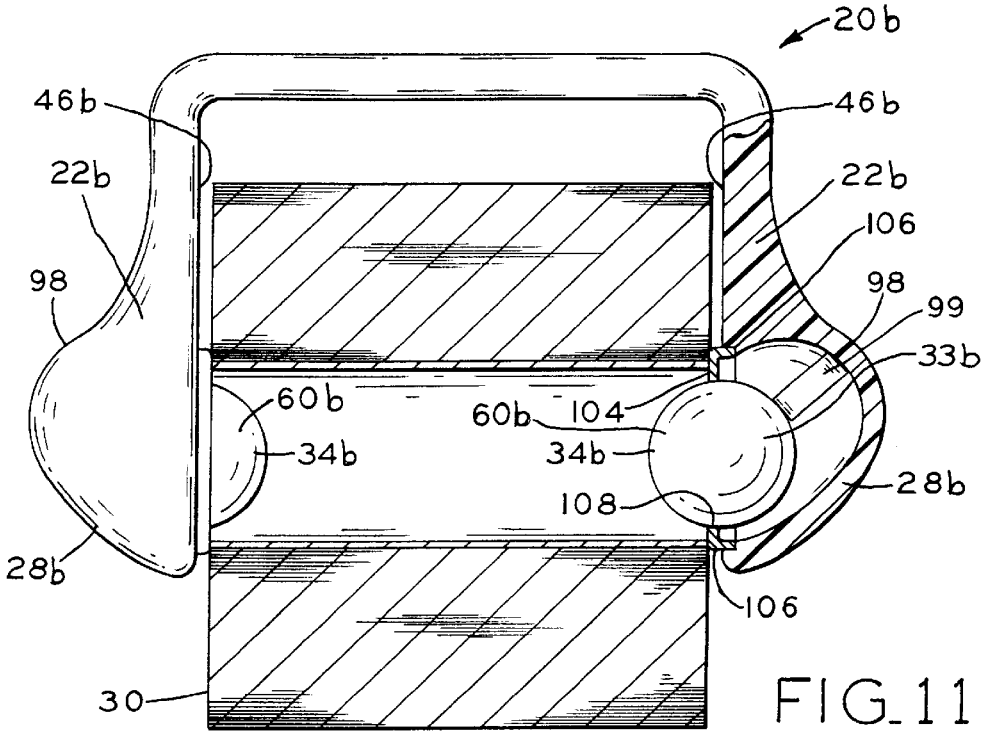
FIG. 11 is a top view in partial cross-section of a third embodiment of a rolled product dispenser assembly according to the present invention, showing an engaged roll.
Figure 12:
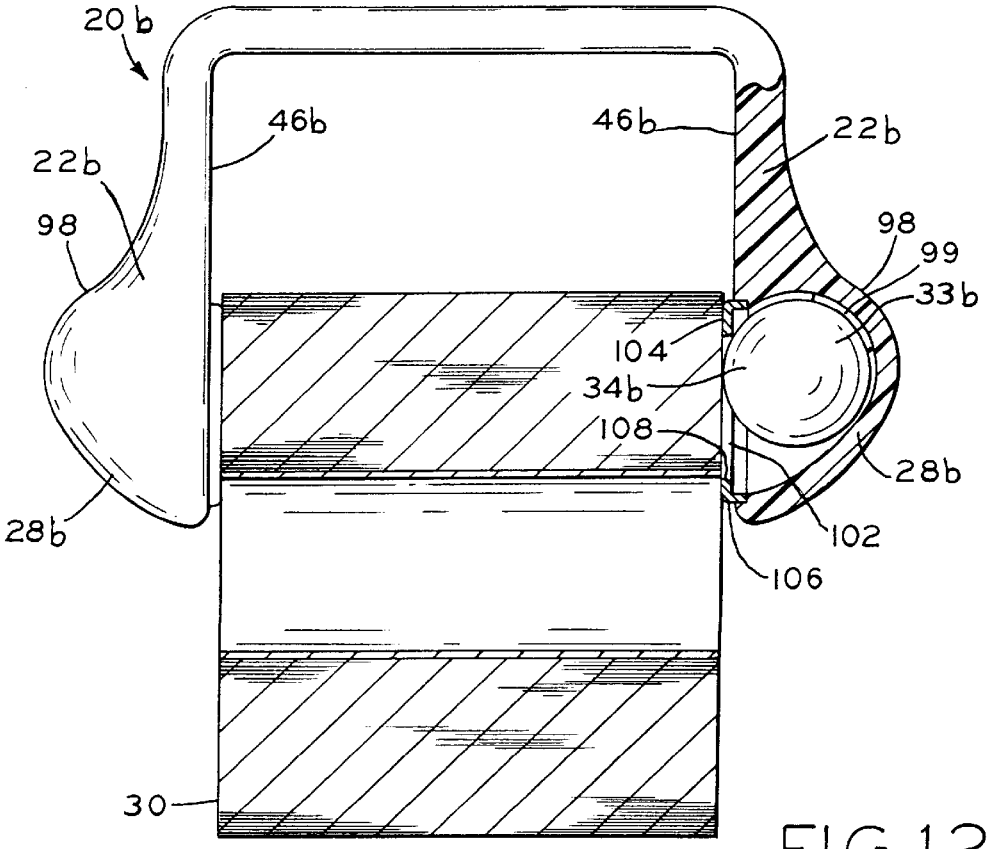
FIG. 12 is a top view in partial cross-section of the rolled product dispenser assembly of FIG. 11, showing the roll disengaged between the arms.

A third embodiment of the dispenser assembly 20*b* of the present invention is shown in FIGS. 11 and 12 and includes a pair of rollers 33*b* comprising spheres 34*b* within a pair of enclosures 98 and differs from the previously disclosed embodiments by including structure to allow spheres 34*b* to freely rotate and translate within enclosures 98. Enclosures 98 are positioned at second ends 28*b* of arms 22*b*. As mentioned above, spheres 34*b* have the capability of freely rotating and translating within enclosures 98, however, when roll 30 is engaged with dispenser assembly 20*b*, as shown in FIG. 11, spheres 34*b* seat within retainer 104. Each retainer 104 includes outer perimeter 106 and seat portion 108 defining opening 102. Each retainer 104 is located proximate to inner surface 46*b* of second end 28*b* of arms 22*b*.

With roll 30 positioned on dispenser assembly 20*b*, spheres 34*b* seat against retainer 104 such that engaging portions 60*b* of each sphere 34*b* are in substantial contact with each seat portion 108 and engaging portions 60*b* extend generally into core 35 of roll 30. Spheres 34*b* are urged to seat within the respective retainer 104 by magnetic attraction between each sphere 34*b* and each retainer 104. Magnetic attraction between each sphere 34*b* and respective retainer may be obtained by each sphere being a magnet and the retainer being of an iron alloy or each sphere may be an iron alloy and the respective retainer a magnet. Likewise, sphere 34*b* may be urged against retainer 104 by gravitational force. Vertical orientation of enclosure 98, whereby each retainer 104 is positioned below each enclosure 98, would result in the respective sphere 34*b* naturally migrating to the lowest position corresponding to seat portion 108 of retainer 104. Yet another alternative is to urge each sphere 34*b* against the retainer by placing a resilient member 99 (FIGS. 11–12) behind sphere 34*b* and within enclosure 98 at a position opposing retainer 104. A resilient member such as a spring, piece of foam, piece of rubber, or like object fixed to the inside of each enclosure 98 and in contact with each sphere 34*b* would provide an adequate opposing bias to force sphere 34*b* against retainer 104. During installation and removal of roll 30 at least one sphere 34*b* is displaced and becomes unseated corresponding to spheres 34*b* receding into the respective enclosure 98. As stated above only one sphere 34*b* need associate with second end 28*b* of the respective arm 22*b* to effectively dispense rolled product.

A fourth embodiment of the dispenser assembly 20*c* of the present invention is shown in FIG. 13 and includes a pair of rollers 33*c* rigidly attached to a pair of arms 22*c*. Rollers 33*c* comprise a pair of hemispheres 110 and are attached to inner sides 46*c* of second ends 28*c* of arms 22*c*. When roll 30 (not shown in FIG. 13) is brought into contact with hemispheres 110, at least one of the second ends 28*c* spreads apart and once roll 30 is engaged with dispenser assembly 20*c*, arms 22*c* return and roll 30 is positioned such that an engaging portion positioned on each hemisphere 110 extends into core 35 of roll 30.

Figure 14:
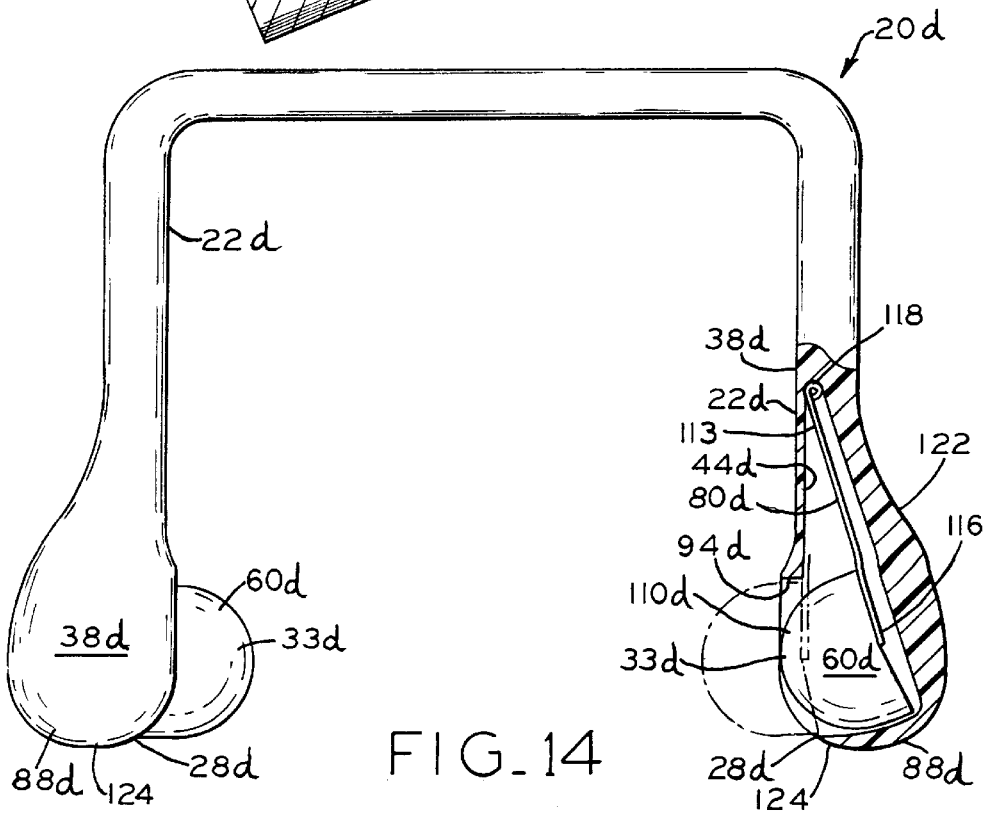
FIG. 14 is a top view in partial cross-section of a fifth embodiment of a rolled product dispenser assembly according to the present invention.

A fifth embodiment of the dispenser assembly 20*d* of the present invention is shown in FIG. 14 and incorporates a pair of connecting members 80*d* pivotally attached to a pair of outer surfaces 44*d* of arms 22*d*. Each connecting member 80*d* has first end 113 and second end 116. First end 113 of each connecting member 80*d* includes hinge 118 attached to outer surface 44*d* of each arm 22*d*. Second end 116 of each connecting member 80*d* has roller 33*d* rigidly attached. Similar to the fourth embodiment dispenser assembly 20*c*, dispenser assembly 20*d* includes rollers 33*d* comprising hemispheres 110*d*. Each arm 22*d* includes second ends 28*d* having apertures 94*d* being of a diameter slightly larger than the diameter of each hemisphere 110*d*. Torsion spring 88*d*, to return each connecting member 80*d* to the respective outer surface 44*d* of arm 22*d*, is located proximate to hinge 118 so that each connecting member 80*d* overlays each outer surface 44*d* of each arm 22*d*. When roll 30 (not shown in FIG. 14) is engaged with dispenser assembly 20*d*, each hemisphere 110*d* extends into core 35 of roll 30 having engaging portion 60*d* of each hemisphere 110*d* generally extending into core 35. Cover 88*d* encloses and protects each connecting member 80*d* and hemisphere 110*d* by joining top 38*d*, bottom 40*d* (not shown in FIG. 14), and front surface 124 of each arm 22*d* together.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A dispenser assembly for dispensing product arranged in a roll, the roll including a cavity disposed at each end thereof, comprising:

a base;

a pair of arms, said arms each having first and second ends, said first ends attached to said base and said second ends extending outwardly from said base;

a roller associated with one of said second ends, said roller including a roll engaging portion, said roll engaging portion of said roller structured and arranged to extend from said second end into the cavity of the roll when the roll is inserted into said arms; and at least one connecting member, said connecting member including a first end and a second end, said first end of said connecting member rotatably attached to the respective said arm, said second end of said connecting member attached to the respective roller, said connecting member rotatably attached to the respective arm, whereby said connecting member being capable of rotating when the roll is urged against said roller.

2. The dispenser assembly of claim 1 wherein the roll is supported exclusively by said roll engaging portion.

3. The dispenser assembly of claim 1 further comprising a seat formed on said second end of each arm, said seat supportingly contacting the roll, said engaging portion of each said roller contacting the respective cavity of the roll at a contact point.

4. The dispenser assembly of claim 1 wherein said roll engaging portion of said roller is hemispherical.

5. The dispenser assembly of claim 1 wherein said roller is rotatably attached to said second end of the respective said arms, whereby said roller rotates when the roll is urged between said arms.

6. The dispenser assembly of claim 5 wherein said roller is generally spherical.

7. The dispenser assembly of claim 5 wherein at least one of said arms is capable of deflecting contemporaneously when the respective said roller rotates upon engagement of the roll.

8. The dispenser assembly of claim 5 wherein at least one of said arms is capable of deflecting contemporaneously when the respective said roller rotates upon disengagement of the roll.

9. The dispenser assembly of claim 1 wherein said arms are generally disposed in a horizontal plane, each said roller rotates in said horizontal plane.

10. The dispenser assembly of claim 1 wherein said base comprises a support surface and each said first ends of said pair of arms are attached to said support surface.

11. The dispenser assembly of claim 1 wherein said base comprises an elongate member integrally attached to said first ends of each said arms.

12. The dispenser assembly of claim 1 wherein said base comprises an elongate member, said pair of arms being pivotally attached to said base.

13. The dispenser assembly of claim 1 wherein said connecting member deflects contemporaneously with the rotation of said roller.

14. The dispenser assembly of claim 13 wherein said pair of arms are disposed in a generally horizontal plane, each connecting member attached to a respective said arm being generally aligned with said respective said arm, said roller being capable of rotating within said horizontal plane.

15. A dispenser assembly for dispensing product arranged in a roll, the roll including a cavity disposed at each end thereof, comprising:

a base;

a pair of arms, said arms each having first and second ends, said first ends attached to said base and said second ends extending outwardly from said base;

a roller associated with one of said second ends, said roller including a roll engaging portion, said roll engaging portion of said roller structured and arranged to extend from said second end into the cavity of the roll when the roll is inserted into said arms, wherein said second end of said pair of arms forms an enclosure and said roller is disposed within said enclosure; and a retainer which retains said roller in said enclosure, wherein said roller is resiliently urged against said retainer by magnetic force, whereby said roller contacts said retainer when the roll is generally engaged with said roll engaging portion of said roller.

16. The dispenser assembly of claim 15 wherein said roller is capable of contemporaneously rotating and receding into said enclosure when the roll is disengaged and urged out from between said pair of arms.

17. The dispenser assembly of claim 15 wherein said roller is also resiliently urged against said retainer by gravitational force.

18. A dispenser assembly for dispensing product arranged in a roll, the roll including a cavity disposed at each end thereof, comprising:

a base;

a pair of arms, said arms each having first and second ends, said first ends attached to said base and said second ends extending outwardly from said base;

a roller associated with one of said second ends, said roller including a roll engaging portion, said roll engaging portion of said roller structured and arranged to extend from said second end into the cavity of the roll when the roll is inserted into said arms, wherein said second end of said pair of arms forms an enclosure and said roller is disposed within said enclosure; and a retainer which retains said roller in said enclosure, wherein said roller is resiliently urged against said retainer by a resilient member, whereby said roller contacts said retainer when the roll is generally engaged with said roll engaging portion of said roller.

19. The dispenser assembly of claim 18 wherein said roller is capable of contemporaneously rotating and receding into said enclosure when the roll is disengaged and urged out from between said pair of arms.

20. The dispenser assembly of claim 18 wherein said roller is also resiliently urged against said retainer by gravitational force.

* * * * *